US011549481B1

(12) United States Patent
Perkins

(10) Patent No.: US 11,549,481 B1
(45) Date of Patent: Jan. 10, 2023

(54) ROTARY GENERATOR

(71) Applicant: David W. Perkins, Cedar Rapids, IA (US)

(72) Inventor: David W. Perkins, Cedar Rapids, IA (US)

( * ) Notice: Subject to any disclaimer, the term of this patent is extended or adjusted under 35 U.S.C. 154(b) by 0 days.

(21) Appl. No.: 17/685,844

(22) Filed: Mar. 3, 2022

(51) Int. Cl.

| | |
|---|---|
| ***F03B 17/06*** | (2006.01) |
| ***B63B 35/44*** | (2006.01) |
| ***B63B 21/50*** | (2006.01) |
| *B63B 21/26* | (2006.01) |

(52) U.S. Cl.
CPC ..... *F03B 17/065* (2013.01); *B63B 21/50* (2013.01); *B63B 35/44* (2013.01); *B63B 21/26* (2013.01); *B63B 2035/4466* (2013.01); *F05B 2220/706* (2013.01); *F05B 2240/20* (2013.01)

(58) Field of Classification Search
CPC ..... F03B 17/065; B63B 21/50; B63B 35/44; B63B 21/26; B63B 2035/4466; F05B 2220/706; F05B 2240/20
See application file for complete search history.

(56) References Cited

U.S. PATENT DOCUMENTS

| | | | | |
|---|---|---|---|---|
| 4,494,007 | A | 1/1985 | Gaston | |
| 2019/0031301 | A1* | 1/2019 | De Haas | F03B 13/10 |

* cited by examiner

*Primary Examiner* — Viet P Nguyen
(74) *Attorney, Agent, or Firm* — Brett J. Trout

(57) ABSTRACT

A system for converting fluid flow into electricity. The system has an arm assembly with four floats that rotate around a center float. The floats on the arm assembly are all provided with impellers that turn one half revolution for every one revolution of the arm assembly. This slow rotation maintains the impellers at the optimal angle to convert the flow of the water current into rotational motion of the arm assembly, regardless of the orientation of the arm assembly. The arm assembly is coupled to an electric generator provided on the center float that converts torque generated by the arm assembly into electric power that may either be stored on an on-board battery or transmitted by wire for use elsewhere.

18 Claims, 4 Drawing Sheets

ROTARY GENERATOR

TECHNICAL FIELD

The disclosed embodiments relate generally to rotary generator and, in particular, to a floating rotary generator for converting a water current in a body of water into electric energy.

BACKGROUND

Green energy has become a global phenomenon, with countries funding, and consumers demanding, renewable energy production methods that generate less carbon than fossil fuels, such as oil, coal, and the like, and that emit fewer undesirable byproducts, such as carbon dioxide, methane, nitrous oxide, etc. It is known in the art to provide renewable energy systems that harvest energy from wind and sun. One drawback is that these systems cannot generate energy in the absence of wind and sun. It is known to produce energy from water flow. One drawback of such prior art systems is that they often required a portion of the waterway to be permanently ceded to the system, to the exclusion of other desirable uses of the waterway. It would therefore be desirable to provide a readily removable system for generating energy from a waterway.

When exploring the wilderness it is often desirable to bring a system for generating electricity. As noted above, while portable solar and wind-generated systems are known to produce electricity, they are dependent on the sun shining and/or the wind blowing. It is known to provide propeller-driven portable water-powered electric generators, but for shallower waterways, these systems require multiple smaller generators strung across the waterway. It would be desirable to use a single generator to capture power across a shallow stream or river. While it is known to provide larger propeller-driven portable water-powered electric generators, these systems often require deep water. It would therefore be desirable to provide a portable system for generating energy from a shallow low-flow waterway.

Although portable water-powered electric generators are known, such prior art systems are heavy, costly, fragile, and/or expensive to maintain. It would therefore be desirable to provide a light reasonably priced, sturdy, easily repaired and maintained system for generating energy from a waterway.

SUMMARY OF THE DISCLOSED SUBJECT MATTER

The deficiencies described above are overcome by the disclosed implementation of a fluid-driven energy output assembly. The assembly has an electric generator coupled to an arm assembly having four arms connected radially outward from a central hub. Attached to each arm is a small sprocket connected to a larger sprocket with a chain. The larger sprocket is journaled through a float to an impeller that is located under the water when the float is floating on the water. The remaining three arms are similarly constructed except that the impellers associated with each of the four arms are offset from the nearest impellers by forty-five degrees. In operation, the assembly is floated and anchored in a moving body of water. As the water current flows across the assembly the current pushes against the full face of the impeller moving downstream, while moving across the streamlined edge of the impeller moving upstream to drive the arm assembly in a clockwise motion. The farthest upstream and farthest downstream impellers are angled forty-five degrees relative to the flow of the water current, but in opposite directions, so as to push the arm assembly in a clockwise motion, thereby turning the electric generator and generating electricity.

Other implementations of fluid-driven energy output assemblies are disclosed, including implementations directed to mesh geared and deep-water fluid-driven energy output assemblies.

BRIEF DESCRIPTION OF THE DRAWINGS

The present invention will now be described, by way of example, with reference to the accompanying drawings in which.

DETAILED DESCRIPTION OF THE DRAWINGS

The system of the present invention converts fluid current into electric energy. The system described below is distinguished over earlier systems in that the present system is portable and may be used to generate large amounts of electricity in shallow streams. The use of long arms and rotating impellers increase the torque supplied to the electric generator to increase electric output. One embodiment of the present system uses four arms that rotate around a central hub. Provided on the ends of the arms are with floats and rotating impellers. The impellers rotate at a rate half that at which the arms rotate around the central hub. This difference in rotation rate causes the impellers to receive the liquid flow, such as a current of the water flow at an angle that drives the arms in a clockwise direction. The electric generator may either store the electricity on an onboard battery, or transmit the electricity via wire to the shore for any desired use.

Figure 1:
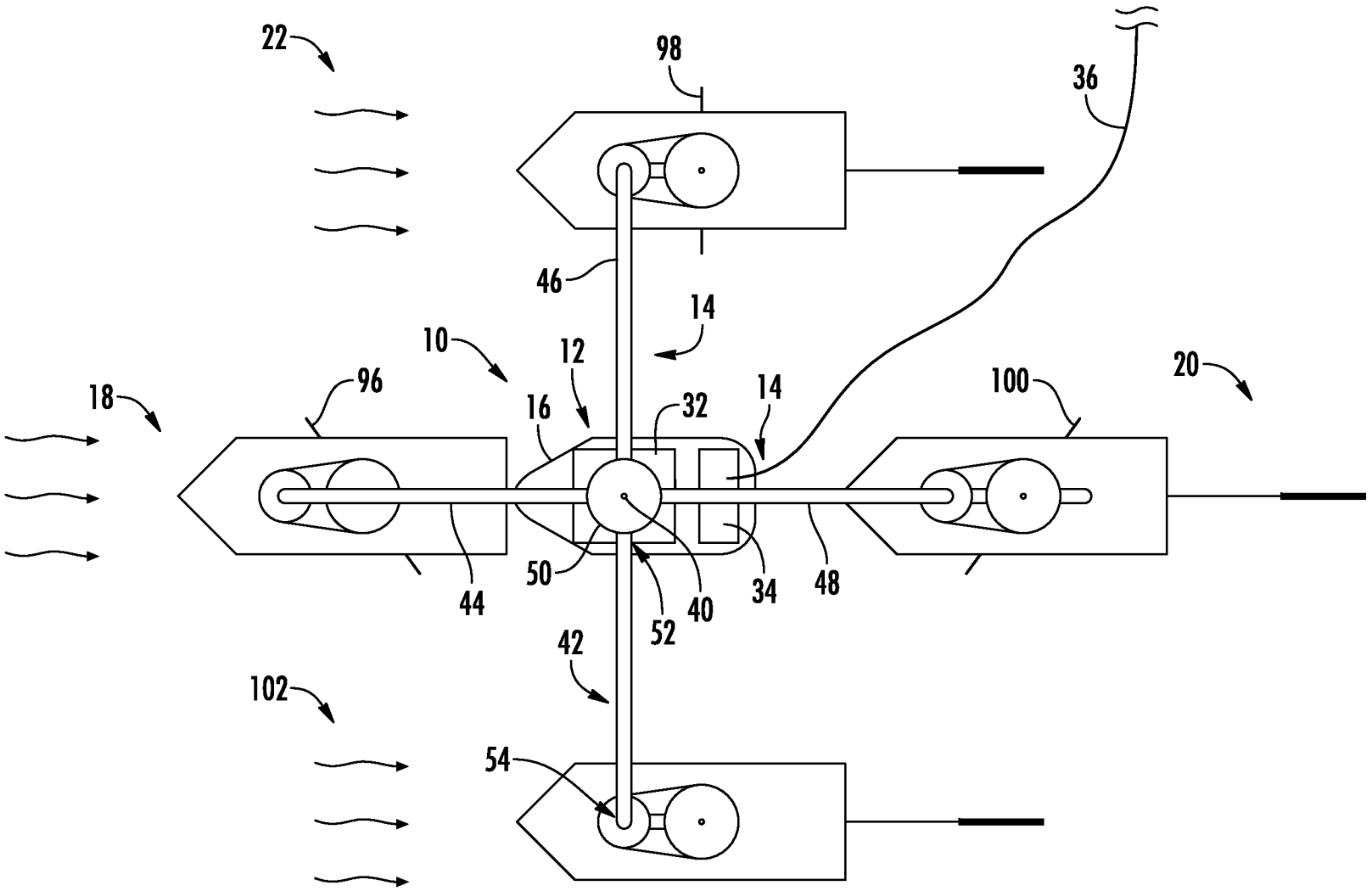
FIG. 1 illustrates a top elevation of the energy output assembly in accordance with one embodiment.
Figure 2:
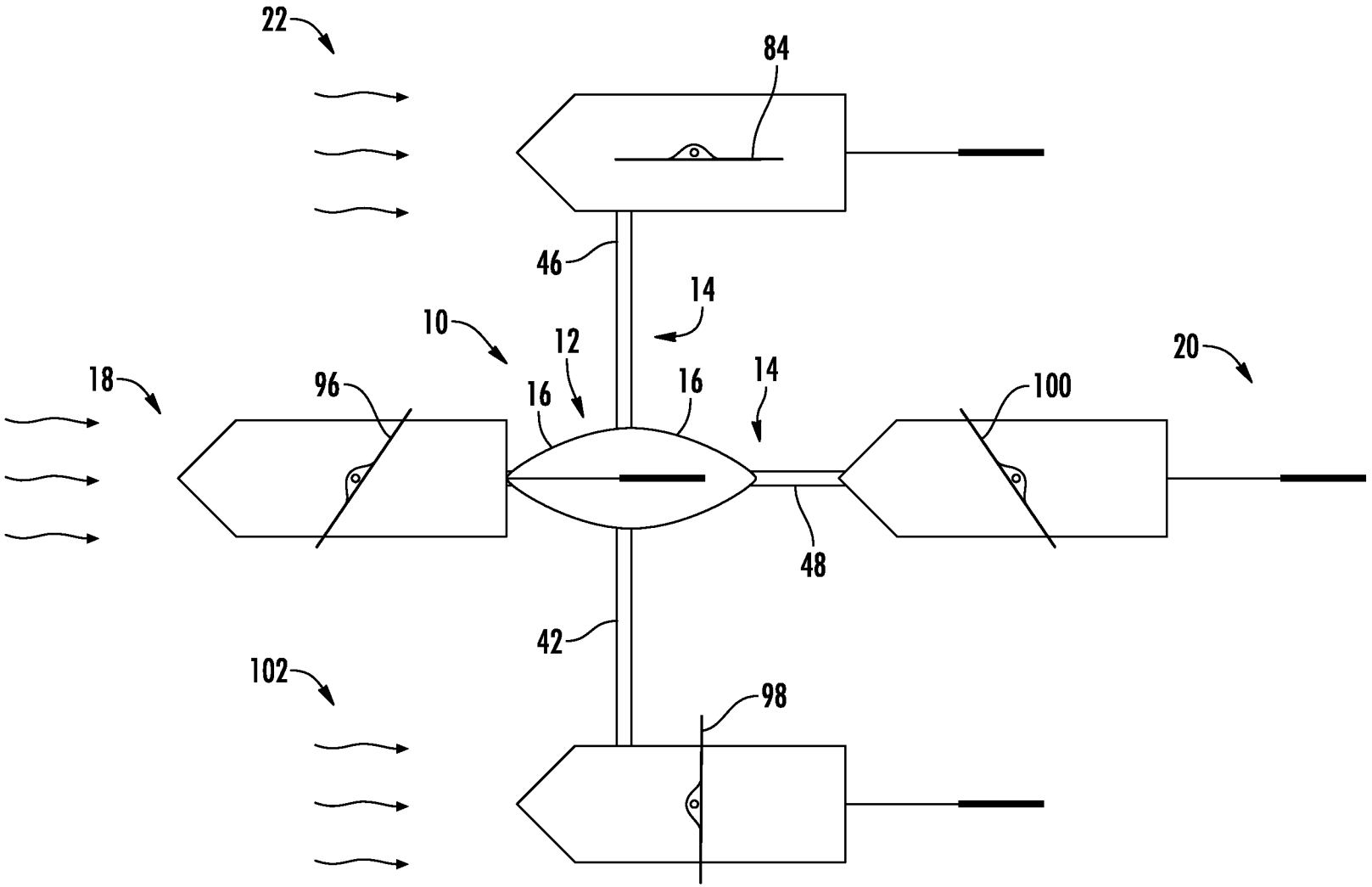
FIG. 2 illustrates a bottom elevation of the energy output assembly in accordance with one embodiment.

An embodiment of the liquid driven energy output assembly of the present invention is shown generally as (10) in FIGS. 1-2 as a water driven energy output assembly. As shown, the assembly (10) is provided with a central float (12) to which is secured an arm assembly (14). The central float (12) may be constructed of any desired material, but in the preferred embodiment, the central float (12) is constructed of a rigid outer shell (16) made of thermoplastic, fiberglass, carbon fiber, or the like, filled with a buoyant material (not shown), such as expandable foam, closed-cell extruded polystyrene foam, air, or the like. Alternatively, the central float (12) may be solid polystyrene foam or the like and may be constructed of any desired dimensions. Preferably, the central float (12) is tapered at the bow (18) to keep the output assembly (10) centered and tapered at the stern (20) to reduce turbulence in the water (22) flowing past the central float (12).

Secured to the bottom of the central float (12) is a stainless steel ring (24), that is used to connect an anchor line (26), which is turn connected to an anchor (28). Stainless steel rings (24), anchor lines (26), and anchors (28) are all well known in the art and are preferably selected for this embodiment of the invention to secure the output assembly (10) to the bed (30) of the stream (32) river, or other body of water into which the output assembly (10) is placed. The ring (24) is preferably secured to the central float (12) closer to the bow (18) than to the stern (20), but not so far toward the bow (18) that the anchor line (26) pulls the bow (18) under the water (22) during maximum water current flow.

Secured to the top of the central float (12) is an electric generator (32). The generator (24) may be or any type known in the art, but is preferably a direct current electric generator. The generator (24) may be coupled to a battery (34), such as those known in the art, or coupled to an insulated wire (36) to transmit the electric output to the shore (38).

The arm assembly (14) is journaled to a shaft (40) of the electric generator (32) by a bearing (not shown) or similar assembly to allow the arm assembly (14) to rotate relative to the electric generator (32). The arm assembly (14) has four arms (42), (44), (46), (48) coupled to a central steel hub (50) that is bolted, or otherwise secured to the shaft (40) of the electric generator (32). In the preferred embodiment, but may have three, five, or any desired number of arms. As the four arms (42), (44), (46), (48) are similar except for having impellers offset forty-five degrees from one another, description will be limited to a single arm (42). The arm (42) is a steel bar with its near end (52) welded or otherwise secured to the hub (50) and offset from the adjacent arms (44), (46), by forty-five degrees.

Figure 3:
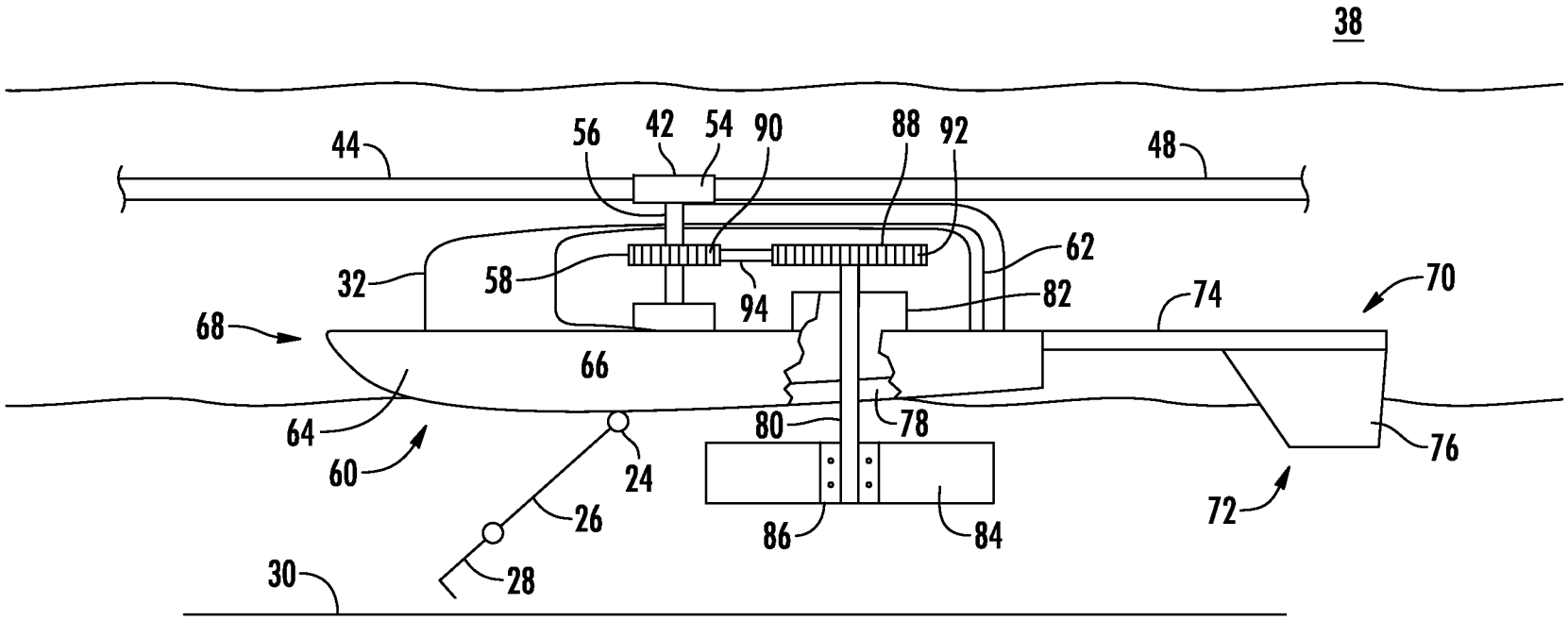
FIG. 3 illustrates a side elevation in partial cutaway of the energy output assembly in accordance with one embodiment.
Figure 4:
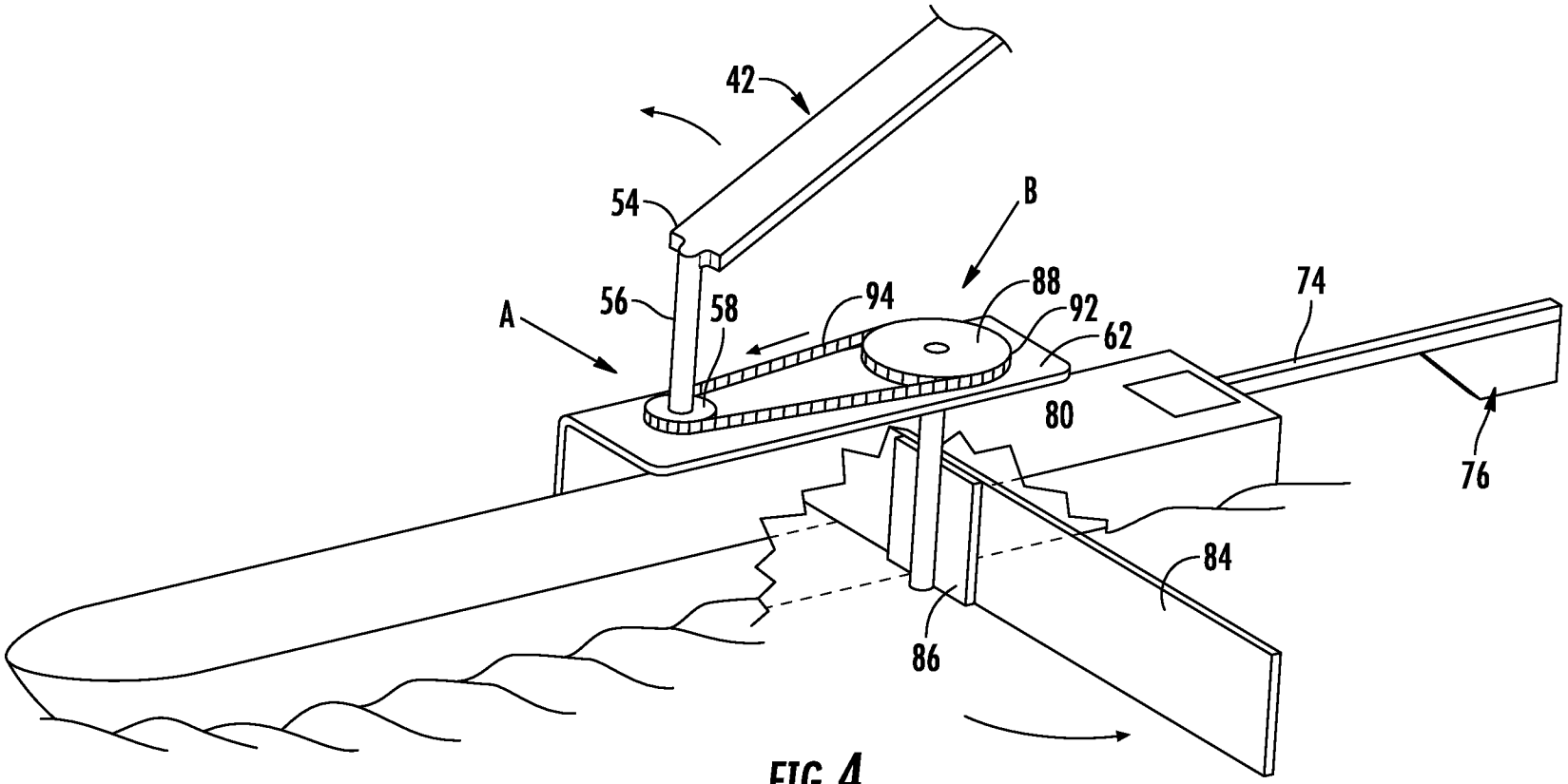
FIG. 4 illustrates a top perspective view in partial cutaway of a float assembly of the energy output assembly in accordance with one embodiment.

As shown in FIGS. 3-4, a far end (54) of the arm, (42) is secured to a steel shaft (56) that is in turn secured to a torque transfer assembly, such as a sheave and belt (not shown) or a small toothed sprocket (58) and chain (94), such as known in the art. The sprocket (58) preferably has between 1 and 80 teeth, more preferably between 5 and 25 teeth, and most preferably 16 teeth. The float assembly (60) has a frame, such as a float bracket (62), which is a tubular stainless-steel section having a rounded-square cross-section, and which is secured to the arm float (64) by bolts or other fastening methods known in the art. The shaft (54) extends through the top of the float bracket (62) and is secured to the sprocket (58). Secured to the bottom interior of the float bracket (62) is a bearing (66) journaled to the bottom of the shaft (54).

Like the central float (12), the arm float (64) is preferably constructed of a rigid outer shell (16) made of thermoplastic, fiberglass, carbon fiber, or the like, filled with a buoyant material (not shown), such as expandable foam, closed-cell extruded polystyrene foam, air, or the like. The arm float (64) may be solid polystyrene foam or the like and may be constructed of any desired dimensions, but is preferably provided with a tapered bow (68) and a flat stern (70) and is longer and narrower than the central float (12). For use in fast flowing or turbulent water, the arm float (64) may be larger, longer, and wider, and for use in slower, calmer water the arm float (64) may be smaller, shorter, and narrower. Secured to the underside of the arm float (64) is a rudder (72), that is preferably constructed of aluminum or similarly rigid material. The rudder (70) has a spine (74) secured on one end to the top of the stern (68) of the arm float (64) and on the other end to a tapered plate (76). The length of the spine (74) and the configuration of the plate (76) is preferably adapted to efficiently exploit the depth, water current, and turbulence of body of water in which the output assembly (10) will be used.

A second bushing (78) is secured to bottom interior of the float bracket (62) and around a shaft (80). The shaft (80) is provided through the float bracket (62) and through another bushing (82) secured to the underside of the arm float (64). The shaft (78) is secured to an impeller (84) by a bracket (86), which is secured to both the shaft (78) and the impeller (84) by bolts, weldments, or the like. The impeller (84) is preferably constructed of a rectangular piece of aluminum 1 cm to 200 cm high, 0.1 cm to 5 cm thick, and 5 cm to 500 cm long, more preferably 5 cm to 50 cm high, 0.2 cm to 2 cm thick, and 10 cm to 100 cm long, and most preferably 10 cm high, 0.5 cm thick, and 40 cm long, but may be constructed of steel, fiberglass, plastic or any desired material of any desired dimensions. The dimensions of the impeller (84) are preferably adapted to efficiently exploit the depth, water current, and turbulence of body of water in which the output assembly (10) will be used, as well as the desired electric output of the output assembly (10).

The top of the shaft (80) is secured to a large sheave (not shown) or large toothed sprocket (88). The sprocket (88) such as known in the art, preferably has between 2 and 160 teeth (90), more preferably between 10 and 50 teeth (90), and most preferably 32 teeth (90). The sprocket (78) may be of any desired dimensions, but is preferably provided with twice the number of teeth as the sprocket (58). Teeth (90) of the sprocket (78) are coupled to teeth (92) of the sprocket (58) by a flexible endless band, such as a belt or a chain (94) in a manner such as that known in the art. To operate the energy output assembly (10), the energy output assembly (10) is placed in a body of water (22), such as a stream or a river. The anchor (28) is secured to the bed (30) of the body of water (22). Alternatively, the anchor line (26) may be secured to a post (not shown) in the water (22) or on the shore, or may be secured to a floating vessel (not shown). As shown in FIG. 2, the impellers (84), (96), (98), and (100) are offset from one another by forty-five degrees. The impeller (84) on the port side of the energy output assembly (10) is parallel to the flow of the water current (102). When the water (22) in the current (102) strikers the impeller (84), the impeller (84) presents a very narrow profile to the current (102) thereby causing the current (102) to impart little drag onto the impeller (84). The impeller (96) toward the bow of the energy output assembly (10) is angled forty-five degrees clockwise from a line parallel to the flow of the current (102). When the water (22) in the current (102) strikers the impeller (96), the impeller (84) presents an angled profile to the current (102) thereby causing the current (102) to impart a force on the impeller (96) to both the starboard and stern. As the impeller (96) cannot move to the stern, the current (102) forces the impeller (96) starboard, causing the arm assembly (14) to turn clockwise relative to the central float (12) and the electric generator (32).

The impeller (98) toward the starboard of the energy output assembly (10) is angled perpendicular to a line parallel to the flow of the water current (102). When the water (22) in the current (102) strikers the impeller (98), the impeller (98) presents a profile fully facing the current (102), thereby causing the current (102) to impart a force on the impeller (98) to the stern. This causes the impeller (96) to turn the arm assembly (14) clockwise relative to the central float (12) and the electric generator (32). The impeller (100) toward the stern of the energy output assembly (10) is angled forty-five degrees counterclockwise from a line parallel to the flow of the water current (102). When the water (22) in the current (102) strikers the impeller (100), the impeller (100) presents an angled profile to the current (102) thereby causing the current (102) to impart a force on the impeller (100) to both the port and stern. As the impeller (100) cannot move to the stern, the current (102) forces the impeller (100)

port, causing the arm assembly (14) to turn clockwise relative to the central float (12) and the electric generator (32).

As the arm assembly (14) rotates clockwise, the differential between the number of teeth (90) on the sprockets (58) and the number of teeth (92) on the sprockets (78) causes the impellers (84), (96), (98), and (100) to rotate one half of a revolution for each revolution of the arm assembly (14). This means that whichever impeller is to the port is always parallel to the water current (102), the whichever impeller is to the bow is always rotated forty-five degrees clockwise relative to the current (102), whichever impeller is to the starboard is always perpendicular to the current (102), and whichever impeller is to the stern is always rotated forty-five degrees counterclockwise relative to the current (102). In this manner, except when an impeller is perfectly parallel to the flow of the water current (102), all of the impellers (84), (96), (98), and (100) are constantly forcing the arm assembly (14) toward a clockwise rotation.

As the arm assembly (14) rotates clockwise, the arm assembly (14) rotates the shaft (40) of the electric generator (32) clockwise, thereby causing the electric generator (32) to produce electricity. The electricity produced may either be stored in the battery (34), or transmitted via the wire (36) for use as desired.

Although the invention has been described with respect to a preferred embodiment thereof, it is to be understood that it is not to be so limited since changes and modifications can be made therein which are within the full, intended scope of this invention as defined by the appended claims.

What is claimed is:

1. A liquid driven energy output assembly comprising:
- a. an anchor;
- b. a central float coupled to the anchor;
- c. an arm assembly coupled to the central float, the arm assembly comprising;
  - i. a first arm;
  - ii. a second arm;
- d. a first sprocket secured to the first arm, the first sprocket having a first diameter;
- e. a first float assembly comprising:
  - i. a first float journaled to the first arm;
  - ii. a first rudder coupled to the first float;
  - iii. a second sprocket journaled to a first frame, the second sprocket having a second diameter;
  - iv. wherein the second diameter is larger than the first diameter;
  - v. a first shaft coupled to the second sprocket;
  - vi. a first impeller coupled to the first shaft;
- f. a first endless band drivably coupled to the first sprocket and to the second sprocket;
- g. a third sprocket secured to the second arm, the third sprocket having a third diameter;
- h. a second float assembly comprising:
  - i. a second float journaled to the second arm;
  - ii. a second rudder coupled to the second float;
  - iii. a fourth sprocket journaled to a second frame, the fourth sprocket having a fourth diameter;
  - iv. wherein the fourth diameter is larger than the third diameter;
  - v. a second shaft coupled to the fourth sprocket;
  - vi. a second impeller coupled to the second shaft; and
- i. a second endless band drivably coupled to the third sprocket and to the fourth sprocket.

2. The liquid driven energy output assembly of claim 1, wherein the arm assembly further comprises:
- a. a third arm;
- b. a fourth arm;

and further comprising:
- a. a fifth sprocket secured to the third arm, the fifth sprocket having a fifth diameter;
- b. a third float assembly comprising:
  - i. a third float journaled to the third arm;
  - ii. a third rudder coupled to the third float;
  - iii. a sixth sprocket journaled to a third frame, the sixth sprocket having a sixth diameter;
  - iv. wherein the sixth diameter is larger than the fifth diameter;
  - v. a third shaft coupled to the sixth sprocket;
  - vi. a third impeller coupled to the third shaft;
- c. a third endless band drivably coupled to the fifth sprocket and to the sixth sprocket;
- d. a seventh sprocket secured to the fourth arm, the seventh sprocket having a seventh diameter;
- e. a fourth float assembly comprising:
  - i. a fourth float journaled to the fourth arm;
  - ii. a fourth rudder coupled to the fourth float;
  - iii. an eighth sprocket journaled to a fourth frame, the eighth sprocket having an eighth diameter;
  - iv. wherein the eighth diameter is larger than the seventh diameter;
  - v. a fourth shaft coupled to the eighth sprocket;
  - vi. a fourth impeller coupled to the fourth shaft; and
- f. a fourth endless band drivably coupled to the seventh sprocket and to the eighth sprocket.

3. The liquid driven energy output assembly of claim 2, wherein the first float, the second float, the third float, and the fourth float are all parallel to one another.

4. The liquid driven energy output assembly of claim 2, wherein the second impeller is configured to be angled between 40 and 50 degrees relative to the first impeller, wherein the third impeller is configured to be angled between 40 and 50 degrees relative to the second impeller, wherein the fourth impeller is configured to be angled between 40 and 50 degrees relative to the third impeller, and wherein the first impeller is configured to be angled between 40 and 50 degrees relative to the first impeller.

5. The liquid driven energy output assembly of claim 1, wherein the second diameter is twice the first diameter.

6. The liquid driven energy output assembly of claim 1, wherein the first sprocket and the second sprocket are toothed sprockets and wherein the first endless band is a chain.

7. The liquid driven energy output assembly of claim 1, wherein the first sprocket and the second sprocket are sheaves and wherein the first endless band is a belt.

8. The liquid driven energy output assembly of claim 1, wherein the first sprocket, the second sprocket, and the first endless band are configured so that every revolution of the first sprocket generates two revolutions in the second sprocket.

9. The liquid driven energy output assembly of claim 1, wherein the first sprocket, the second sprocket, and the first endless band are configured so the first impeller rotates through an orientation perpendicular to a liquid flow when moving in a direction with the liquid flow and rotates through an orientation parallel to the liquid flow when moving in the direction against the liquid flow.

10. The liquid driven energy output assembly of claim 1, wherein the first frame is coupled to a first buoyant material and the second frame is coupled to a second buoyant material.

11. The liquid driven energy output assembly of claim 1, further comprising an electric generator coupled to, and motively driven by, the arm assembly.

12. A liquid driven energy output assembly comprising:

a. an anchor;

b. a central float coupled to the anchor;

c. an arm assembly coupled to the central float, the arm assembly comprising;

i. a first arm;

ii. a second arm;

iii. a third arm;

iv. a fourth arm;

d. a first sprocket secured to the first arm, the first sprocket having a first diameter;

e. a first float assembly comprising:

i. a first frame journaled to the first arm;

ii. a sufficient amount of a first buoyant material coupled to the first frame to float the first float assembly in liquid;

iii. a first rudder coupled to the first float;

iv. a second sprocket journaled to the first frame, the second sprocket having a second diameter;

v. wherein the second diameter is larger than the first diameter;

vi. a first shaft coupled to the second sprocket;

vii. a first impeller coupled to the first shaft;

f. a first endless band drivably coupled to the first sprocket and to the second sprocket;

g. a third sprocket secured to the second arm, the third sprocket having a third diameter;

h. a second float assembly comprising:

i. a second frame journaled to the second arm;

ii. a sufficient amount of a second buoyant material coupled to the second frame to float the second float assembly in liquid;

iii. a second rudder coupled to the second float;

iv. a fourth sprocket journaled to the second frame, the fourth sprocket having a fourth diameter;

v. wherein the fourth diameter is larger than the third diameter;

vi. a second shaft coupled to the fourth sprocket;

vii. a second impeller coupled to the second shaft; and i. a second endless band drivably coupled to the third sprocket and to the fourth sprocket;

j. a fifth sprocket secured to the third arm, the fifth sprocket having a fifth diameter;

k. a third float assembly comprising:

i. a third frame journaled to the third arm;

ii. a sufficient amount of a third buoyant material coupled to the third frame to float the third float assembly in liquid;

iii. a third rudder coupled to the third float;

iv. a sixth sprocket journaled to the third frame, the sixth sprocket having a sixth diameter;

v. wherein the sixth diameter is larger than the fifth diameter;

vi. a third shaft coupled to the sixth sprocket;

vii. a third impeller coupled to the third shaft;

l. A third endless band drivably coupled to the fifth sprocket and to the sixth sprocket;

m. a seventh sprocket secured to the fourth arm, the seventh sprocket having a seventh diameter;

n. a fourth float assembly comprising:

i. a fourth frame journaled to the fourth arm;

ii. a sufficient amount of a fourth buoyant material coupled to the fourth frame to float the fourth float assembly in liquid;

iii. a fourth rudder coupled to the fourth float;

iv. an eighth sprocket journaled to the fourth frame, the eighth sprocket having an eighth diameter;

v. wherein the eighth diameter is larger than the seventh diameter;

vi. a fourth shaft coupled to the eighth sprocket;

vii. a fourth impeller coupled to the fourth shaft;

o. a fourth endless band drivably coupled to the seventh sprocket and to the eighth sprocket; and p. an electric generator coupled to, and motively driven by, the arm assembly.

13. The liquid driven energy output assembly of claim 12, wherein the second diameter is twice the first diameter.

14. The liquid driven energy output assembly of claim 12, wherein the first sprocket and the second sprocket are toothed sprockets and wherein the first endless band is a chain.

15. The liquid driven energy output assembly of claim 12, wherein the first sprocket and the second sprocket are sheaves and wherein the first endless band is a belt.

16. The liquid driven energy output assembly of claim 12, wherein the first sprocket, the second sprocket, and the first endless band are configured so that every revolution of the first sprocket generates two revolutions in the second sprocket.

17. The liquid driven energy output assembly of claim 12, wherein the first sprocket, the second sprocket, and the first endless band are configured so the first impeller rotates through an orientation perpendicular to a liquid flow when moving in the direction with the liquid flow and rotates through an orientation parallel to the liquid flow when moving in the direction against the liquid flow.

18. A liquid driven energy output assembly comprising:

a. an anchor;

b. a central float coupled to the anchor;

c. an arm assembly coupled to the central float, the arm assembly comprising;

i. a first arm;

ii. a second arm;

iii. a third arm;

iv. a fourth arm;

d. a first sprocket secured to the first arm, the first sprocket having a first diameter;

e. a first float assembly comprising:

i. a first frame journaled to the first arm;

ii. a sufficient amount of a first buoyant material coupled to the first frame to float the first float assembly in liquid;

iii. a first rudder coupled to the first float;

iv. a second sprocket journaled to the first frame, the second sprocket having a second diameter;

v. wherein the second diameter is larger than the first diameter;

vi. a first shaft coupled to the second sprocket;

vii. a first impeller coupled to the first shaft;

f. a first endless band drivably coupled to the first sprocket and to the second sprocket;

g. a third sprocket secured to the second arm, the third sprocket having a third diameter;

h. a second float assembly comprising:

i. a second frame journaled to the second arm;

ii. a sufficient amount of a second buoyant material coupled to the second frame to float the second float assembly in liquid;

iii. a second rudder coupled to the second float;

iv. a fourth sprocket journaled to the second frame, the fourth sprocket having a fourth diameter;

v. wherein the fourth diameter is larger than the third diameter;

vi. a second shaft coupled to the fourth sprocket;

vii. a second impeller coupled to the second shaft; and i. a second endless band drivably coupled to the third sprocket and to the fourth sprocket;

j. a fifth sprocket secured to the third arm, the fifth sprocket having a fifth diameter;

k. a third float assembly comprising:

i. a third frame journaled to the third arm;

ii. a sufficient amount of a third buoyant material coupled to the third frame to float the third float assembly in liquid;

iii. a third rudder coupled to the third float;

iv. a sixth sprocket journaled to the third frame, the sixth sprocket having a sixth diameter;

v. wherein the sixth diameter is larger than the fifth diameter;

vi. a third shaft coupled to the sixth sprocket;

vii. a third impeller coupled to the third shaft;

l. A third endless band drivably coupled to the fifth sprocket and to the sixth sprocket;

m. a seventh sprocket secured to the fourth arm, the seventh sprocket having a seventh diameter;

n. a fourth float assembly comprising:

i. a fourth frame journaled to the fourth arm;

ii. a sufficient amount of a fourth buoyant material coupled to the fourth frame to float the fourth float assembly in liquid;

iii. a fourth rudder coupled to the fourth float;

iv. an eighth sprocket journaled to the fourth frame, the eighth sprocket having an eighth diameter;

v. wherein the eighth diameter is larger than the seventh diameter;

vi. a fourth shaft coupled to the eighth sprocket;

vii. a fourth impeller coupled to the fourth shaft;

o. a fourth endless band drivably coupled to the seventh sprocket and to the eighth sprocket; and p. wherein the first sprocket, the third sprocket, the fifth sprocket, and the seventh sprocket are configured to maintain the second impeller angled between 40 and 50 degrees relative to the first impeller, the third impeller angled between 40 and 50 degrees relative to the second impeller, the fourth impeller angled between 40 and 50 degrees relative to the third impeller, and the first impeller angled between 40 and 50 degrees relative to the fourth impeller.

* * * * *